US007913631B2

(12) United States Patent
Hawkins

(10) Patent No.: US 7,913,631 B2
(45) Date of Patent: Mar. 29, 2011

(54) MODULAR PORTABLE TABLE

(76) Inventor: Dennis A. Hawkins, Warren, OH (US)

( * ) Notice: Subject to any disclaimer, the term of this patent is extended or adjusted under 35 U.S.C. 154(b) by 358 days.

(21) Appl. No.: 12/120,638

(22) Filed: May 14, 2008

(65) Prior Publication Data

US 2008/0282942 A1 Nov. 20, 2008

Related U.S. Application Data

(60) Provisional application No. 60/917,762, filed on May 14, 2007.

(51) Int. Cl.
*A47B 57/00* (2006.01)

(52) U.S. Cl. ..... 108/92; 108/185; 108/186

(58) Field of Classification Search ..... 108/91–93, 108/101, 180, 185, 186, 193, 26, 97
See application file for complete search history.

(56) References Cited

U.S. PATENT DOCUMENTS

| | | | | |
|---|---|---|---|---|
| 3,567,300 | A * | 3/1971 | Mari | 312/257.1 |
| 4,355,585 | A * | 10/1982 | Bottamiller et al. | 108/157.13 |
| 4,709,640 | A * | 12/1987 | Jouanin | 108/91 |
| 4,714,027 | A * | 12/1987 | Stern | 108/60 |
| 5,025,749 | A * | 6/1991 | Sutherland | 118/28 |
| 5,746,139 | A * | 5/1998 | Villanueva | 108/92 |
| 6,341,566 | B1 * | 1/2002 | Hwang | 108/180 |
| 6,948,435 | B1 * | 9/2005 | Sheng | 108/192 |
| 7,610,864 | B2 * | 11/2009 | LaMarche et al. | 108/93 |
| 2003/0066813 | A1 * | 4/2003 | Taylor | 211/186 |
| 2003/0075083 | A1 * | 4/2003 | Devey | 108/92 |
| 2004/0154499 | A1 * | 8/2004 | Weatherly | 108/180 |
| 2007/0151490 | A1 * | 7/2007 | Pflaster | 108/180 |

FOREIGN PATENT DOCUMENTS

CH 669507 A * 3/1989

* cited by examiner

*Primary Examiner* — Hanh V Tran
(74) *Attorney, Agent, or Firm* — Howard M. Cohn

(57) ABSTRACT

A portable modular table includes a main base unit of a lower frame section, an upper frame section secured to the lower frame section and a counter top removably attached to the upper frame section. The portable modular table can further include one or more attachment components for mounting to the main base unit in a number of configurations.

19 Claims, 3 Drawing Sheets

MODULAR PORTABLE TABLE

CROSS-REFERENCE TO RELATED APPLICATIONS

This application claims priority to U.S. Provisional Patent Application Ser. No. 60/917,762, entitled "DECKMIESTER, filed May 14, 2007, the disclosure of which is hereby expressly incorporated herein by reference.

TECHNICAL FIELD OF THE INVENTION

The present invention relates generally to preparation and serving of food in the out-of-doors. More specifically, the present invention relates to a portable modular table and methods for assembling the portable modular table for use in preparing and serving food at camp sites, backyard patios and other outdoor venues.

BACKGROUND OF THE INVENTION

It is common for people to spend time in the outdoors in social settings, such as picnics, barbeques, and tailgating at sporting events. At these events, food and drink are served, and this presents a number of problems. Being that the events take place outdoors, it is difficult to have an effective staging area for serving and storing the food. When there are existing structures, such as a picnic tables or the bed of a truck at a tailgate party, the surfaces are generally both unclean and unhygienic. In a remote location, such as in the woods, there may not be any man-made structures to place the food, and this is both inconvenient and unclean if the food must be kept on the ground.

It was known in the prior art to provide outdoor kitchen type devices. These outdoor kitchen devices of the prior art are typically employed for storing food stuffs to be transported to an outdoor site and for food preparation. The outdoor site can be a campsite, a camping facility for recreational vehicles or any other outdoor activity typically removed from one's residence. In the alternative, the outdoor site can be as local as a barbecue grill located at a city park, the beach or even on the patio or in the back yard of one's residence. A typical outdoor field kitchen device known in the prior art included a structure having a top work surface and storage shelves. The field kitchen device was formed entirely from steel tubing and consequently was very heavy, cumbersome and unstable. Thus the field kitchen device was difficult to transport, assemble and disassemble.

The present invention seeks to solve these problems and to make these outdoor social situations more clean, hygienic, and generally more pleasant for the participants.

ASPECTS AND SUMMARY OF THE INVENTION

An aspect of the present invention is to provide a portable modular table that can be easily assembled and disassembled.

Another aspect of the present invention is to provide a portable modular table that can be assembled in a number of different configurations.

A further aspect of the present invention is to provide a portable table that can be constructed of various light weight materials.

A still further object of the present invention is to provide a portable table that can be easily transported.

A yet further object of the present invention is to provide a portable table that is generally stable once assembled.

A further aspect of the present invention is to provide a portable table that is relatively inexpensive to manufacture.

Briefly, and in general terms, the present invention provides a new and improved portable modular table for use in preparing and serving food outdoors in social settings. The novel and non-obvious portable modular table exhibits a robust lightweight design of a lightweight material such as for example plastic. The portable modular table is assembled and disassembled quickly and easily since tools are not required. The horizontal work surface can be positioned at the standard countertop height to facilitate food preparation. When disassembled, the portable modular table can be transported and stored in a waterproof carrying enclosure.

In addition, there is a need for a portable modular table to which one or more side tables can be attached in a number of configurations for functions such as accommodating the serving of meals and the support of cooking equipment.

According to the present invention, there has been provided a portable modular table comprising main base unit constructed with a lower frame section supported by first and second lower vertical supports; an upper frame section supported by first and second upper vertical supports; the first and second upper vertical supports removably secured to the lower frame section; a counter top forming an upper work surface of the modular table; and the counter top being removably attached to the upper frame section.

Further according to the present invention, an upstanding mounting strip extends at least partially across the upper frame section; and the counter top has a slot extending along the length of an undersurface thereof and the slot receives the upstanding mounting strip to secure the counter top to the upper frame section. Also, the counter top is attached along a front side to the upper frame section whereby the opposite rear side of the counter top is cantilevered outward from the upper frame section. Also, at least one vertical support leg is removably secured to the counter top to keep the upper work surface of the counter top parallel with the upper frame section.

Still further according to the present invention, a stabilizing support is mounted to the upper frame section and removably secured to the lower frame section to stabilize the upper frame section with respect to the lower frame section. The stabilizing support is mounted to the underside of the upper frame section and is removably secured within a slot formed in a support mounted on the lower frame section.

Also according to the present invention, the lower frame includes a bottom shelf having the stabilizing support with a slot disposed thereon. The bottom shelf also has two spaced slotted supports disposed on an upper surface thereof for attaching the first and second upper vertical supports.

Yet further according to the present invention, the first and second lower vertical supports are hingedly connected to the lower frame section, the first and second upper vertical supports are hingedly connected to the upper frame section, and the stabilizing support is hingedly mounted to the upper frame section.

Still further according to the present invention, the upper frame section has a rectangular opening sized to mount a plurality of boards. The upper frame section is constructed with oppositely disposed end walls and oppositely disposed side walls. In addition, a plurality of slots for connecting other structures to the portable modular table are disposed in an upper surface of the end walls and side walls.

According to the present invention, the portable modular table includes one or more attachment components for mounting to the upper and lower frame sections of the main base unit. The one or more attachment components having a support frame with an attachment slot there through, an attachment counter attached to the support frame, and a bottom attachment shelf having one end extending through the attachment slot and disposed substantially parallel to the attachment counter.

Also according to the present invention, the attachment counter has a tongue projecting from a free end opposite the end extending through attachment slot. The tongue is adapted to be received in one of the plurality of slots in the upper frame section for connecting the attachment component to the main base unit of the portable modular table. The bottom attachment shelf of the attachment counter has a lip projecting outward there from to engage the bottom shelf of the portable modular table. Also the attachment counter includes a plurality of slots thereabout for attaching other attachment counters thereto.

According to the present invention, there is provided a method of assembling the main base unit of a portable modular table comprising the steps of: disposing lower vertical supports perpendicular to a bottom shelf of a lower frame section; disposing upper vertical supports perpendicular to a rectangular frame of an upper frame section; installing the upper frame section onto the lower frame section so that the upper vertical supports engage slotted supports on the bottom shelf; placing a counter top in place so as to be cantilevered outward from the upper frame section; and placing at least one legs in place to support the counter top.

Also according to the present invention, the method further includes the step of fitting a stabilizing support between the upper and lower frame sections.

Further according to the present invention, the method includes the steps of assembling an attachment component and attaching the attachment component to the main base unit. The steps of assembling the attachment component putting a rectangular support frame into place perpendicular to an attachment counter and inserting an end of a bottom attachment shelf through a slot in the support frame. Next, a tongue extending down from an end of the attachment counter is placed in a slot in the upper frame section of the main base unit and a lip at an end of the bottom attachment shelf is rested on an edge of the bottom shelf of the main base unit.

Also according to the present invention, the portable modular table can be constructed from a material selected from the group comprising wood, ABS plastic, PVC, Thermo Plastic Olefin, aluminum, powder coated carbon steel and stainless steel.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

Elements of the figures may (or may not) be numbered as follows. The most significant digits (hundreds) of the reference number correspond to the figure number. For example, elements of FIG. 1 are typically numbered in the range of 100-199, and elements of FIG. 2 are typically numbered in the range of 200-299. Similar elements throughout the figures may be referred to by similar reference numerals. For example, the element 199 in FIG. 1 may be similar (and possibly identical) to the element 299 in FIG. 2. Throughout the figures, each of a plurality of elements 199 may be referred to individually as 199*a*, 199*b*, 199*c*, etc. Such relationships, if any, between similar elements in the same or different figures will become apparent throughout the specification, including, if applicable, in the claims and abstract.

Figure 1:
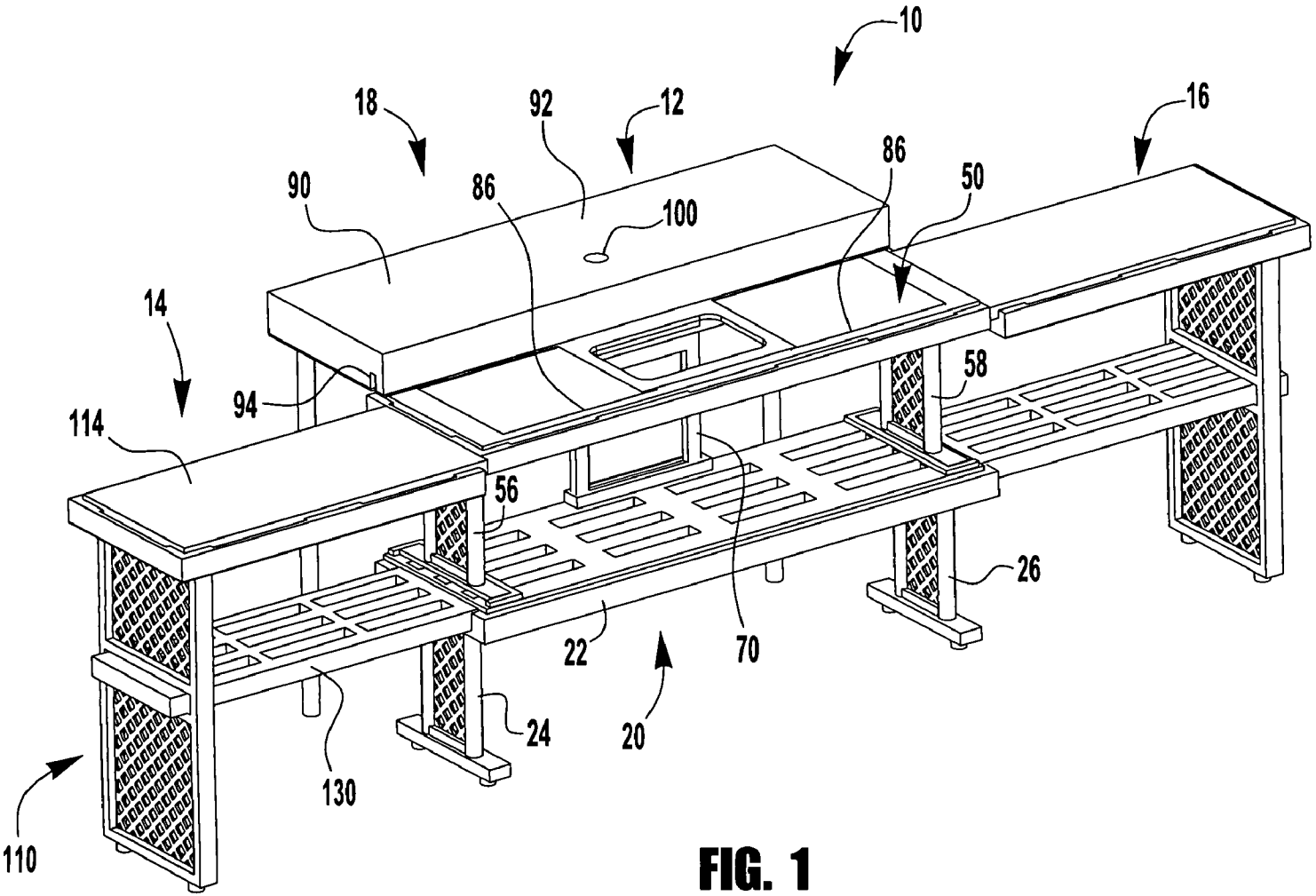

In the drawings accompanying the description that follows, both reference numerals and legends (labels, text descriptions) may be used to identify elements. If legends are provided, they are intended merely as an aid to the reader, and should not in any way be interpreted as limiting.

FIG. 1 is a three dimensional view of a modular portable table, in accordance with the present invention.

Figure 2:
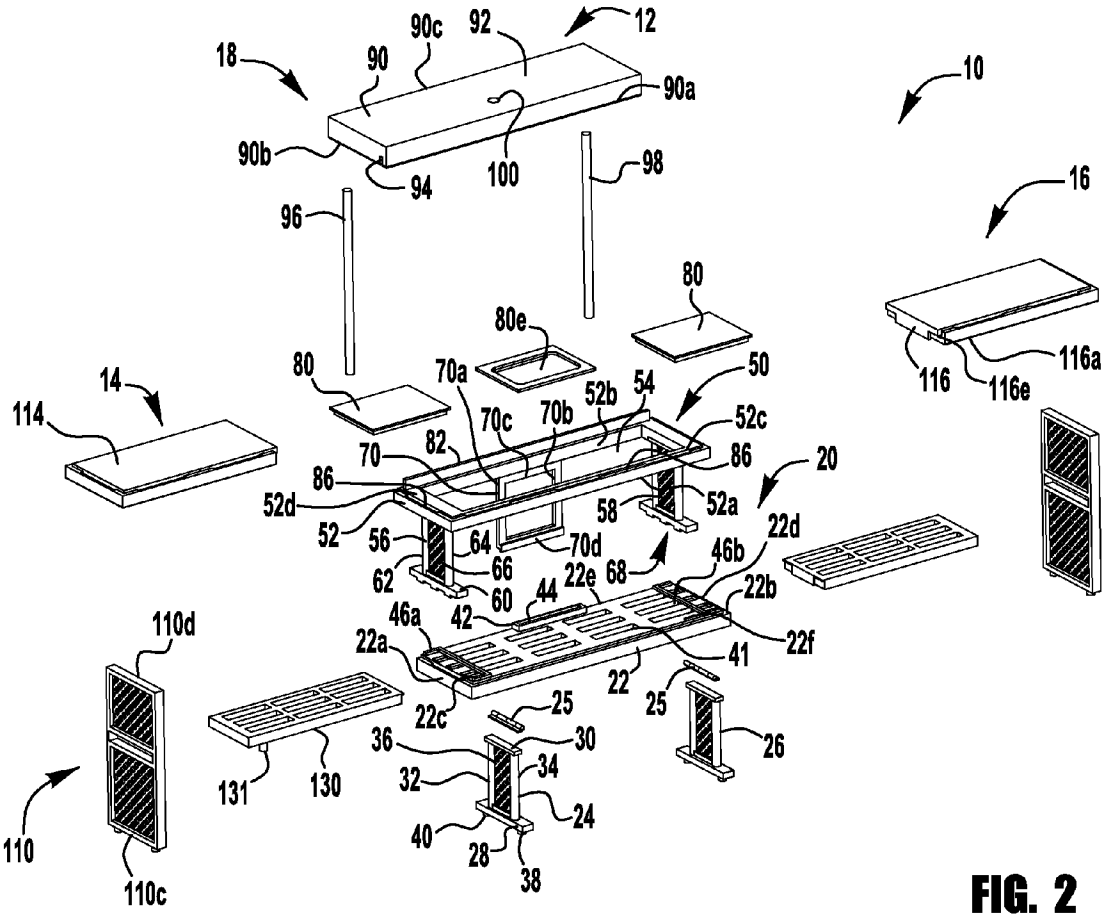

FIG. 2 is an exploded view of the modular portable table, in accordance with the present invention.

Figure 3:
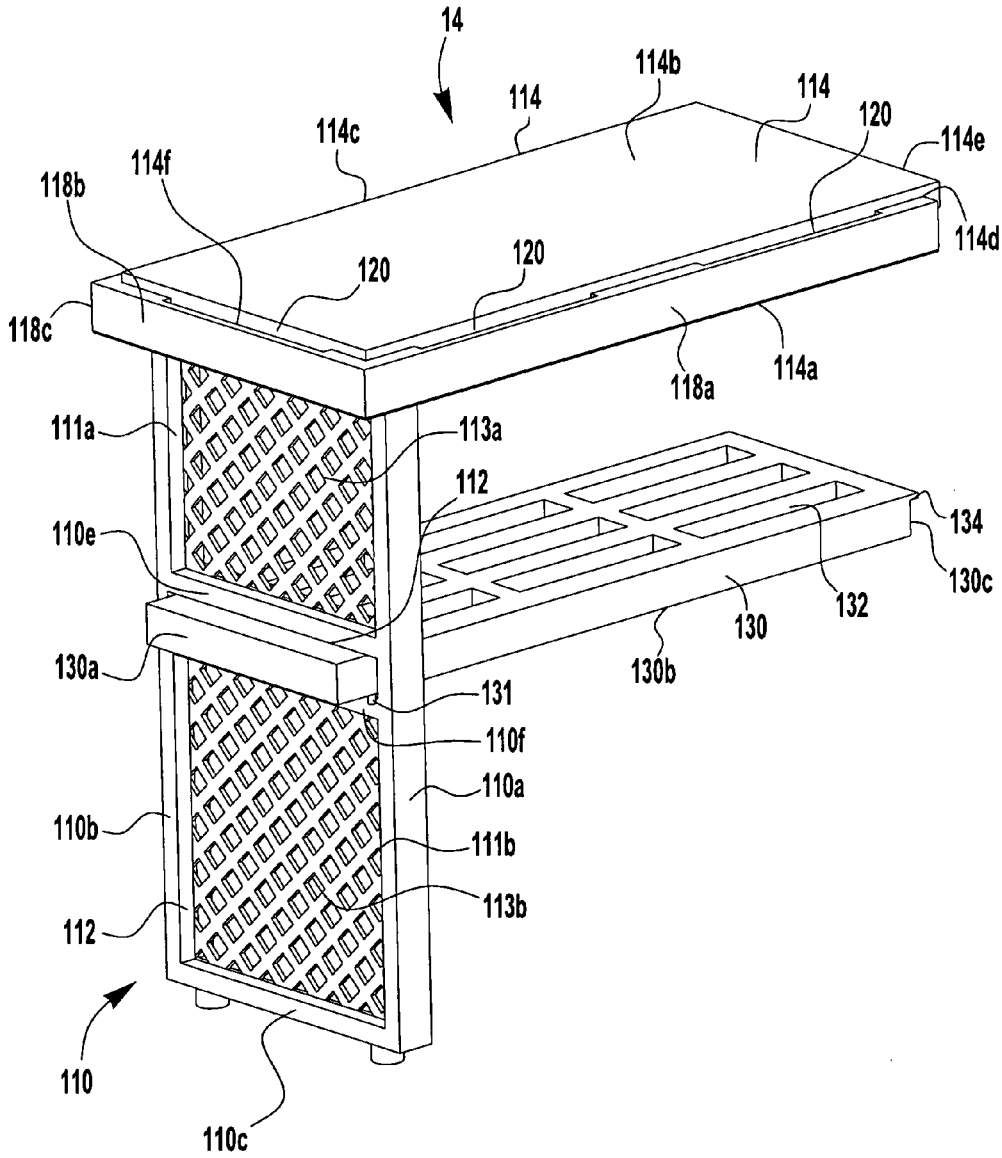

FIG. 3 is a three dimensional view of an optional Dual Level Extension Counter, in accordance with the present invention.

DETAILED DESCRIPTION OF THE PREFERRED EMBODIMENTS

In the description that follows, numerous details are set forth in order to provide a thorough understanding of the present invention. It will be appreciated by those skilled in the art that variations of these specific details are possible while still achieving the results of the present invention. Well-known processing steps and materials are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

Referring to FIG. 1, there is shown a portable, modular, staging, serving and storage platform or table 10. The table 10 consists of a main base unit 12 and, if desired, one or more attachment components 14 and 16. When used in conjunction with each other, the base unit 12 and the attachment components 14, 16 comprise a multi-use, multi-purpose unified system 18.

Referring to FIGS. 1 and 2, a thorough description of the portable, modular, staging, serving and storage table 10 follows. The main base unit 12 includes a lower frame section 20 including a bottom shelf 22 supported by opposing lower vertical supports 24 and 26. The vertical supports 24,26 are preferably secured to the bottom shelf 22 by hinges 25 so that the vertical supports can fold-up against the bottom shelf for storage. The hinges 25 can lock into place by conventional means. The lower vertical supports 24, 26 are generally of the same construction and of a rectangular shape that includes a base element 28, a top element 30, two spaced apart side elements 32, 34 and a lattice insert 36 between the base element, the top element, the two spaced apart side elements so that the vertical support structures are stiff or rigid. Two levelers or adjustable feet 38, 40 can be provided on the underside of the base element 28 to adjust the height of the base element depending on the terrain it is placed.

The bottom shelf 22 preferably has a plurality of parallel slots 41 to reduce the weight of the platform or table 10. Adjacent one side 22*e* of the bottom shelf 22, there is provided a rectangular support 42 with a slot 44 adapted to receive a stabilizer as discussed hereinafter. Adjacent either end 22*a* and 22*b* of the shelf 22, and upon the upper surface 22*f* of the bottom shelf, there is provided a slotted support 46*a*, 46*b*, respectively, which is disposed so as to leave an edge 22*c*, 22*d* of the top surface of the upper surface to receive a lip or projection of an attachment component 14 or 16 as described herein after. The slots formed in the slotted supports 46*a*, 46*b* are sized to receive alignment projections disposed on the bottom of the upper vertical supports described herein after.

Referring again to FIGS. 1 and 2, there is illustrated an upper frame section 50 including a rectangular frame 52 having an open rectangular center section 54 formed there through by opposite, spaced side walls 52*a* and 52*b* and opposite end walls 52*c* and 52*d*. Attached to the undersurface of the end walls 52*c*, 52*d* forming the rectangular frame 52 are vertical supports 56,58 that are preferably secured by hinges (not shown, compare with hinges 25) so that the vertical supports can fold-up towards the against the open center section 54 for storage. The upper vertical supports 56, 58 are generally of the same construction and of a rectangular shape that includes a base element 60, a top element (not shown), two spaced apart side elements 62, 64 and a lattice insert 66 between the base element, the top element, the two spaced apart side elements so that the upper vertical supports are rigid or stiff. A plurality of alignment projections 68 can be provided on the underside of the base elements 60 of the upper vertical supports 56,58 to interconnect with the slots formed in the slotted supports 46*a*, 46*b* of the bottom shelf 22. Note that the slots formed in the slotted supports 46*a*, 46*b* are sized and shaped to receive the alignment projections 68 disposed on the bottom of base element 60 of the upper vertical supports 56, 58 described herein after.

A rectangular stabilizing support 70 is mounted to the underside of the side wall 52*b* of upper frame section 50 and is adapted to be removably secured within the slot 44 of the rectangular support 42 mounted on the upper surface of the bottom shelf 22 of the lower frame section 20 so as to stabilize the upper frame section with respect to the lower frame section. The rectangular stabilizing support 70 can be constructed of two side elements 70*a*, 70*b*, a top element 70*c* and bottom element 70*d*. The bottom element 70*d* is sized to fit into the slot 44 of rectangular support 42. The rectangular stabilizing support 70 is preferably secured to the bottom surface of side wall 52*b* of the upper rectangular frame 52 by hinges 25 (not shown) so that the rectangular stabilizing support can fold-up towards the sidewall 52*a* of the rectangular frame for storage.

The rectangular opening 54 of the upper rectangular frame 52 is sized to receive a plurality of boards 80. The boards 80 can have a lip extending outward from each of the 4 sides of the board. When the board 80 is inserted into one end of the opening 54, it is held in place by two of the opposite lips resting on the opposite upper surfaces of the side walls 52*a*, 52*b* of frame 52 and a third of the lips resting on an upper end surface of the wall 52*c*. While a solid board 80 is shown, it is also within the terms of the invention to provide the board 80 with an opening 80*e* there through. It is further within the terms of the present invention for the opening 80*e* to have any desired configuration, specifically to receive containers of various sizes.

Along the side wall 52*b* of the upper rectangular frame 52 there is an upstanding mounting strip 82 extending along and generally perpendicular to the upper surface of the wall 52*b*. The mounting strip 82 is sized to be received in a slot formed in the bottom of the counter component 92 as described herein after.

Extending into and along the upper surfaces of the walls 52*a*, 52*c* and 52*d* of frame 52 are a plurality of slots 86 used to connect other structures, such as attachment components 14 and 16, to the main base unit. While any number of slots can be provided in each of the sidewalls, preferably, there is a single slot 86 in the upper surfaces of each of the end walls 52*c* and 52*d* and a plurality of slots 86 in the upper surfaces of each of the side wall 52*a*. The use of these slots will be discussed herein after.

A counter top 90 providing the upper work surface 92 of the modular platform or table 10 is removably attached to the upper frame section 50. Counter 90 has a slot 94 extending along the length of the undersurface 90*b* of the counter top 90 disposed near the front end 90*a* of the counter top. The undersurface side of the counter top 90*b* can also be provided with two threaded components (not shown) to receive legs 96 and 98 closer to the opposite rear end 90*c* of the counter top. The legs 96 and 98 can be easily installed or removed from the counter top 90. The counter top 90 can also have a through bore 100 to receive an umbrella (not shown).

To assemble the main base unit 12 of the portable modular table or platform 10, the lower frame 20 is first put in place by unfolding the lower vertical supports 24 and 26 to extend downward and perpendicular to the bottom shelf 22. Then the upper vertical supports 56 and 58 are unfolded and moved to extend downward and perpendicular to the side walls 52*a*, 52*b* and end walls 52*c*,52*d* of rectangular frame 52. Also the stabilizing support can also be moved to extend downward and parallel to the upper vertical supports 56 and 58 and perpendicular to the rectangular frame 52.

Next the upper frame section 50 is installed onto the lower frame section 20 so that the plurality of alignment projections 68 on the underside of the base elements 60 can be fitted into the slots formed in the slotted supports 46*a*, 46*b* of the bottom shelf 22. Also, the stabilizing support 70 can be fitted into the slot 44 of rectangular support 42 of the bottom shelf 22.

Continuing, the legs 96 and 98 can be attached to the counter top 90. The counter top 90 can then be put in place as shown in FIG. 1 with the mounting strip 82 received in slot 94 and the counter top cantilevered outward from the upper frame section 50. In this embodiment, legs 96 and 98 are preferably in place to support the counter top. At this point, the desired number of boards 80 can be put into place within the opening 54.

It is also within the terms of the present invention to position the counter top 90 directly on the upper frame section 50 so that the mounting strip 82 is received in slot 94 and the opposite end 90*c* of the counter top is disposed over the front wall 52*a* of the rectangular frame 52. In this arrangement, the legs 96 and 98 are not used. In order to collapse the main base unit 12, the preceding described steps are practiced in reverse order.

Referring again to FIG. 1, the portable, modular, staging, serving and storage platform or table 10, as described above, consists of a main base unit 12 and one or more attachment components 14 and 16, as shown in more detail in FIG. 3. When the attachment components 14 and/or 16 are used in conjunction with the base unit 12, the result is a multi-use, multi-purpose unified system 10.

The system 10 can be arranged in a multitude of configurations by the end-user. The number of attachment points on the base unit 12 and the number of attachments 14 and 16 connected thereto define the upper limit as to the number of possible configurations. The end-user can arrange the base unit 12 and attachment components 14 and 16 to any desired configuration based upon and predicated by the needs of any particular application. The system's flexibility also allows for configuration to accommodate either right or left-handed users equally. The system has been designed to provide maximum flexibility to the end-user.

Referring now to FIGS. 1 and 3, a description of attachment component 14 follows. It is to be understood, that while only attachment component 14 is described, it is identical with other attachment components such as component 16.

Attachment component 14 includes a rectangular support frame 110 including two side frame components 110*a* and 110*b*, a bottom frame component 110*c*, and a top frame component 110*d*. Within the center portion of the support frame 110 are spaced center frame components 110*e* and 110*f*. The spaced center frame components 110*e* and 110*f* are attached at their ends to side frame components 110*a* and 110*b* and form a through slot 112.

Between the center frame components 110*e* and 110*f*, and the two side frame components 110*a* and 110*b*, the bottom frame component 110*c* and the top frame component 110*d* are two rectangular openings 111*a* and 111*b*. Within the rectangular openings 111*a* and 111*b* are provided lattice insert 113*a* and 113*b*, respectively, to add rigidity to the support frame 110.

The rectangular support frame 110 can include two levelers on the underside of the frame component 110*c* to adjust the location of the base element depending on the terrain it is placed.

An attachment counter 114 is provided and has the rectangular support frame 110 preferably secured by hinges (not shown) to the underside 114*a* of the attachment counter so that the support frame can fold-up against the bottom surface 114*a* of the attachment counter 114.

The attachment counter 114 has a top surface 114*b*, two side surfaces 114*c* and 114*d* and opposite end surfaces 144*e* and 114*f*. Side strips 118*a*, 118*c* and 118*d* extend around side surfaces 114*d* and 114*c* and end surfaces 144*f*, respectively. The attachment counter 114 includes an attachment member 116 (See FIG. 2) extending from the top surface 114*b* and downwards towards the undersurface 114*a* of the attachment counter. Also the tongue 116 is spaced from the front end of side surface 114*e* (compare surface 116*e*), as best seen on the counter 16 shown in FIG. 2.

The attachment counter 114 also includes a plurality of slots 120 between the side strips 118*a*, 118*b* and 118*c* and the edges 114*d*, 114*f* and 114*c*, respectively of the attachment counter. The slots 120 are receive the projecting tongue of other attachment structures to secure those attachment structures to attachment counter 114.

The attachment counter 114 also includes a bottom attachment shelf 130. Bottom attachment shelf 130 preferably has a plurality of parallel slots 132 to reduce the weight of the attachment counter 114. At one end 130*a* of the bottom attachment shelf 130, there is provided a tongue 131 extending outward from the bottom surface 130*b* of the attachment shelf. The opposite end 130*c* of the attachment shelf has a lip 134 projecting outward from end surface 130*c*.

To assemble attachment component 14, the rectangular support frame 110 is first unfolded into place, perpendicular to the attachment counter 114. Then the end 130*a* of bottom attachment shelf 130 is inserted through the opening 112 and secured therein by tongue 131 extending downward from the bottom surface 130*b*.

Then, the attachment component 14 can be assembled to the main base unit 12 of the storage platform 10. The attachment component 14 is moved into place so that the tongue 116 extending down from the end 114*e* of the attachment counter is placed in one of the slots 86 along one of the walls 52*a*, 52*c* and 52*d* of upper frame 52 of base unit 12. For example, as shown in FIG. 1, the attachment counter 14 is mounted to one end of the main base unit 12 and another attachment counter 16 is mounted to an opposite end. At the same time, the lip 134 at the end of the bottom attachment shelf 130 can rest on the edge 22*c*, 22*d* of the bottom shelf 22.

Another important aspect of this invention is its streamlined design. The width, height and depth of the invention do not require or use a large amount of floor space when assembled. Therefore, it will create a relatively large amount of serving and display capacity in a relatively small footprint thus creating a high level of efficiency.

Additionally, the system can be easily assembled or disassembled by one or more persons. The invention has been designed to allow for assembly or disassembly without the use or need of any hand or power tools. All system components are designed to go together in a "Dry-Fit" mode of assembly. All parts of the base unit as well as the accessory components will only attach to each other in the manner for which they were designed and intended.

This invention can be produced in a variety of materials. Among those materials are: wood (in a variety of species), ABS plastic, PVC, Thermo Plastic Olefin, aluminum, powder coated carbon steel and stainless steel. However, the product may also be constructed of other materials that are not specifically here named. The invention may have several types of different finishes applied during its manufacture. Examples of such finishes could include, but are not limited to: smooth finish, textured finish, painted finishes or a faux wood-grain finish.

The invention is equally suited for indoor or outdoor use.

Because of its design and construction, this invention would work well on a flat and mostly level surface such as on a patio, a deck, a porch, a driveway or other such surface. However, with the utilization of the ground support stabilizer attachments, the invention would also be well suited for use on a lawn or other non-level applications. The invention is portable.

The invention, in any one or more of its configurations could be used for an individual social gathering at the consumer level. The invention could be equally well suited for use in any commercial environment such as a commercial catering situation or in a restaurant, a hotel, a swimming club, a sports bar, etc.

There could be many other viable utilizations of this invention. This product could be used wherever a consumer requires a large flat surface. An example of such a use would be as in the potting of flowers or plants; or when used in connection with the cleaning or harvesting of fruits or vegetables from a garden. Another secondary use would be to utilize the invention as a work space platform for scrapbooking or the wrapping of gifts or presents. Additionally a student could use the invention's surfaces as a base for the building of science projects. In any of its multiple confirmations, the invention would serve a either a basic storage device or display device providing a large area for such usage.

Because of its assembly and disassembly characteristics, the invention will be highly transportable. This aspect will allow multiple other uses at different locations. Such locations and other uses could be as a serving table at a tail gate party such as at a football game, baseball game or auto race. Other venues for use might include: fishing, hunting or camping trip or on a vacation by a lake or the ocean.

Several primary and secondary potential applications for this product have been identified. However, there are still many other unidentified and yet to be recognized applications that will only be discovered and utilized by the end user of this invention based upon their particular need, application and circumstance.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. A portable modular table comprising:

a main base unit, the main base unit comprising:

a primary lower frame section supported by first and second lower vertical supports, wherein the first and second lower vertical supports are configured to be hingedly connected to the lower frame section so as to fold up against the primary lower frame section;

an upper frame section supported by first and second upper vertical supports, an upstanding mounting strip extends at least partially across the upper frame section, wherein the first and second upper vertical supports are configured to be hingedly connected to the upper frame section so as to fold up against the primary upper frame section;

said first and second upper vertical supports removably mounted to said lower frame section;

a counter top forming an upper work surface of the modular table; and said counter top having a slot extending along the length of an undersurface of the counter top, said slot adapted to receive the upstanding mounting strip to secure the counter top to the upper frame section, wherein said counter top is attached along a front side to said upper frame section whereby the opposite rear side of the counter top is cantilevered outward from said upper frame section; and at least one vertical support legs removably secured to the counter top to keep the upper work surface of the counter top parallel with the upper frame section.

2. The portable modular table of claim 1 further including:

a stabilizing support mounted to said upper frame section and removably secured to the lower frame section to stabilize said upper frame section with respect to said lower frame section.

3. The portable modular table of claim 2 wherein the stabilizing support is mounted to the underside of the upper frame section and is removably secured within a slot formed in a support mounted on the lower frame section so as to stabilize the upper frame section with respect to the lower frame section.

4. The portable modular table of claim 3 wherein the lower frame includes a bottom shelf having the support with a slot disposed thereon.

5. The portable modular table of claim 4 wherein the bottom shelf has two spaced slotted supports disposed on an upper surface of the bottom shelf receiving the first and second upper vertical supports.

6. The portable modular table of claim 3 wherein the stabilizing support is hingedly mounted to the upper frame section.

7. The portable modular table of claim 3 wherein the upper frame section has a rectangular opening sized to mount a plurality of boards.

8. The portable modular table of claim 1 wherein:

the upper frame section has oppositely disposed end walls and oppositely disposed side walls; and a plurality of slots for connecting other structures to the portable modular table, the slots disposed in an upper surface of the end walls and side walls of the upper frame section.

9. The portable modular table of claim 8 further including:

one or more attachment components for attaching to the upper and a lower frame sections of the main base unit;

said one or more attachment components each having:

a support frame with an attachment slot there through;

an attachment counter attached to the support frame; and a bottom attachment shelf extending through the attachment slot and disposed substantially parallel to the attachment counter.

10. The portable modular table of claim 9 wherein the attachment counter has a tongue projecting from a free end, the tongue adapted to be received in one of the plurality of slots for connecting one of the attachment components to the upper frame section of the main base unit.

11. The portable modular table of claim 10 wherein the bottom attachment shelf has a lip projecting outward there from to engage the bottom shelf of the main base unit.

12. The portable modular table of claim 10 wherein the attachment counter includes a plurality of slots thereabout.

13. A method of assembling a main base unit of a portable modular table comprising the steps of:

unfolding lower vertical supports to extend perpendicular to a bottom shelf of a lower frame section to which the lower vertical support is hinged;

unfolding upper vertical supports to extend perpendicular to a rectangular frame of an upper frame section to which the upper vertical support is hinged;

installing the upper frame section onto the lower frame section so that the upper vertical supports engage slotted supports on the bottom shelf;

placing a counter top on the upper frame section so as to be cantilevered outward from the upper frame section; and attaching at least one leg to the counter top to support the counter top, wherein an upstanding mounting strip extends at least partially across the upper frame section, said counter top has a slot extending along the length of an undersurface of the counter top, said slot adapted to receive the upstanding mounting strip to secure the counter top to the upper frame section.

14. The method of claim 13 further including the step of fitting a stabilizing support between the upper and lower frame sections.

15. The method of claim 14 further including the steps of:

assembling an attachment component; and attaching the attachment component to the main base unit.

16. The method of claim 15 further including the steps of:

assembling attachment component by putting a rectangular support frame into place perpendicular to an attachment counter; and inserting an end of a bottom attachment shelf through a slot in the support frame.

17. The method of claim 16 further including the steps of:

placing a tongue extending down from an end of the attachment counter in a slot in the upper frame section of the main base unit; and resting a lip at an end of the bottom attachment shelf on an edge of the bottom shelf of the main base unit.

18. The method of claim 17 including the step of constructing the portable modular table from a material selected from the group consisting of wood, ABS plastic, PVC, Thermo Plastic Olefin, aluminum, powder coated carbon steel and stainless steel.

19. A portable modular table comprising:

a main base unit, the main base unit comprising:

a primary lower frame section supported by first and second lower vertical supports;

an upper frame section supported by first and second upper vertical supports;

an upstanding mounting strip extending at least partially across the upper frame section said first and second upper vertical supports removably mounted to said lower frame section;

a counter top forming an upper work surface of the modular table;

said counter top having a slot extending along the length of an undersurface of the counter top, said slot adapted to receive the upstanding mounting strip to secure the counter top to the upper frame section;

said counter top being removably attached to said upper frame section; and a stabilizing support mounted to said upper frame section and removably secured to the lower frame section to stabilize said upper frame section with respect to said lower frame section;

wherein the stabilizing support is mounted to the underside of the upper frame section and is removably secured within a slot formed in a support mounted on the lower frame section so as to stabilize the upper frame section with respect to the lower frame section; and wherein the first and second lower vertical supports are hingedly connected to the lower frame section, the first and second upper vertical supports are hingedly connected to the upper frame section, and the stabilizing support is hingedly mounted to the upper frame section.

* * * * *